US005845374A

United States Patent [19]

Briggs

[11] Patent Number: 5,845,374

[45] Date of Patent: Dec. 8, 1998

[54] GOLF STRAP GRIPPER

[76] Inventor: Patrick A. Briggs, 220 Houghton St., Oak Harbor, Ohio 43449

[21] Appl. No.: 886,073

[22] Filed: Jul. 2, 1997

[51] Int. Cl.[6] ..... A41D 19/00; A44B 18/00; B65D 63/00

[52] U.S. Cl. ..... 24/442; 24/16 R; 24/306; 2/161.2; 2/161.4

[58] Field of Search ..... 24/442, 304, 306, 24/16 R, 16 PB, 305 P; 2/161.2, 161.4

[56] References Cited

U.S. PATENT DOCUMENTS

| | | | |
|---|---|---|---|
| 2,852,779 | 9/1958 | Roessler | 2/161.2 |
| 3,105,972 | 10/1963 | Christopher | 24/442 |
| 3,274,616 | 9/1966 | Russo | 2/161.2 |
| 4,813,079 | 3/1989 | Reitzel | 2/161.2 |
| 4,815,172 | 3/1989 | Ward | 24/442 |
| 5,086,543 | 2/1992 | Mitchell | 24/442 |
| 5,142,743 | 9/1992 | Hahn | 24/442 |
| 5,197,149 | 3/1993 | Overton | 2/161.4 |
| 5,456,650 | 10/1995 | Williams, Jr. et al. | 2/161.2 |
| 5,517,694 | 5/1996 | Fabry | 2/161.4 |

*Primary Examiner*—Victor N. Sakran
*Attorney, Agent, or Firm*—Jerry Semer

[57] ABSTRACT

The invention is a strap for enhancing one's grip on a golf club. To use the strap one places on a golf glove and grips the club. Then one takes the strap which is a piece of material approximately 17 inches long with loop material of hook and loop fabric on the bottom and hook material of hook and loop fabric on the top and virtually "sandwiches" the end of the strap in to the hook and loop material of the glove, giving a solid attachment between the two. Then one begins wrapping the strap around the hand almost perpendicular to the arm and then continues wrapping upward over the little and ring finger and attaches the hook material on the top of the strap to the loop material on the bottom of the strap. This wrapping around the hand enhances one's grip on the club.

11 Claims, 5 Drawing Sheets

GOLF STRAP GRIPPER

The present invention relates to straps for enhancing ones grip on a golf club and more particularly to a strap that securely holds ones fingers on the golf club but allows the wrist to move freely.

BACKGROUND OF INVENTION

As is well known, it is important to grip a golf club firmly. Many individuals, due to a variety of hand ailments, have problems gripping the golf club. In fact, this invention came about when the inventor's father was having problems gripping the golf club because of injuries to his hand. Thus, one of the objectives of this invention is to create a device that can enable an individual to grip the golf club firmly.

It is also known that one of the main problems in a novice golfers' swing is that they have a tendency to open or loosen their grip on the club shaft. Some inexperienced golfers loosen their grip either during back swing, downswing, or at the transition between downswing and backswing usually meaning that the golf ball is not struck properly and the golfer is not getting full distance or correct direction from his swing.

There have been many attempts to produce a device that would enable the individual golfer to keep a grip on the club throughout the whole swing. The use of a strap and a glove to achieve this objective is shown in U.S. Pat. No. 3274616 to Alie Russo, U.S. Pat. No. 3105972 to Christopher, and U.S. Pat. No. 2852779 to Roessler. In U.S. Pat. No. 3105972 to Christopher and U.S. Pat. No. 2852779 to Roessler, the strap is permanently attached to the glove. Thus, when one is purchasing this device one would have to purchase both the strap and the glove. In the inventor's device an individual would only need to purchase the strap and he could use a golf glove that he already has in his possession. One of the objects of this invention is to produce a strap that can be used with almost any golf glove on the market so that an individual would not have to buy both the golf glove and the strap every time the glove wears out thus saving the individual money. Although Pat. No. 3,274,616 to Russo shows a strap that is not attached to the golf glove the patent to Russo still takes a glove that is specially made with a large piece of hook and loop material such as Velcro on the back. The strap in Russo could not be hooked to gloves readily available on the market. Russo shows a strap that is hooked to the hook and loop material which is just below the knuckles on the glove. Applicant knows of no glove on the market that has hook and loop material on its back just below the knuckles. Also from FIG. 1 in Russo, one sees that the hook and loop material is designed to take up most of the back portion of the glove. Applicant knows of no glove with this large of hook and loop material area. Thus, the glove in Russo would also have to be specially made and purchased by the individual with the strap. Another problem with a specially made glove and strap is that the golf glove would wear out much earlier than the strap. Thus an individual would have to go out and buy a new glove and strap every time the glove wore out even though the strap was still good. One of the objectives of this invention is to create a strap that will outlast the life of the average golf glove.

Inventor's strap also differs from the strap in Russo in that the inventor's strap hooks to itself when it is wrapped around the hand. In Russo the strap is hooked to the glove, wrapped around the hand, and then its hooked back to the glove. Thus, inventor's device depends on the strength of the strap rather than the strength of the glove. The average golf glove, made out of thin, soft leather, will not be as strong as a strap made out of a piece of nylon. Thus, inventor has made a strap that is much stronger than the glove. This means that the strap will hold the individuals grip much better during all parts of the swing. The inventor has also done two other things that are not shown in Russo that will allow his strap to be wound more firmly around the hand and not put undue stress on the glove. First being that the strap in Russo wraps less than one time around the hand. The strap in the inventor's invention wraps around the hand more than 360°. This allows the inventor's strap to be wrapped structurally secure since it completely wraps around the hand and club and attaches to itself. Secondly, the strap in Russo wraps over the fingers in the same direction that the fingers wrap around the golf club. In the inventor's invention the strap is wrapped around the fingers at an angle in the opposite direction of Russo insuring a firm grip.

Russo also differs from the inventor's invention in that Russo's strap could never be used with an off the shelf golf glove. To attach to the hook and loop fabric of the regular golf glove, one would have to attach to the portion of the golf glove that has a hook and loop fabric for tightening the golf glove near the wrist. This portion is usually at the base of the glove. If Russo's was hooked to this hook and loop fabric and pulled over the fingers at approximately the same angle as the fingers as shown in Russo, the bottom of the glove would be pulled forward and cause the glove to fit poorly on the hand. Thus, one of the objectives of this invention is to create a strap that works with the average type of golf glove and can be wrapped easily around the hand to ensure a firm grip.

SUMMARY OF THE INVENTION

The invention is a strap for enhancing one's grip on a golf club. To use the strap one places on a golf glove and grips the club. Then one takes the strap which is a piece of material approximately 17 inches long with loop material of hook and loop fabric on the bottom and hook material of hook and loop fabric on the top and virtually "sandwiches" the end of the strap in to the hook and loop material of the glove, giving a solid attachment between the two. Then one begins wrapping the strap around the hand almost perpendicular to the arm and then continues wrapping upward over the little and ring finger and attaches the hook material on the top of the strap to the loop material on the bottom of the strap. This wrapping around the hand enhances one's grip on the club.

SHORT DESCRIPTION OF THE DRAWINGS

FIG. one is the top view of the invention.

FIG. two is the bottom view of the invention.

FIG. three is a view of a hand wearing a regular golf glove and the strap with an arrow showing how the strap is attached to the glove.

FIG. four is a view of the golf glove with the strap attached to the golf glove with an arrow showing how the glove is further attached to the strap.

FIG. five is a view of the back of the golf glove on the hand with the strap fully attached with an arrow showing how the strap is wrapped around the hand.

FIG. six is a view of the back of a golf glove on the hand with the hand gripping a golf club and the strap attached to the glove with an arrow showing how the strap is wrapped around the glove and the fingers of the glove.

FIG. seven is a view of the golf glove on the hand gripping the golf club with the strap wrapped around the glove showing the strap wrapping over the back of the glove.

FIG. eight is a side view of the glove with the hand within gripping the golf club with the strap fully wrapped around the glove showing how the strap attaches to itself FIG. nine is a view of the glove with the hand within gripping the golf club showing the underside of the hand and showing the strap fully wrapped around the hand.

DETAILED DESCRIPTION OF THE PREFERRED EMBODIMENT

Figure 1:
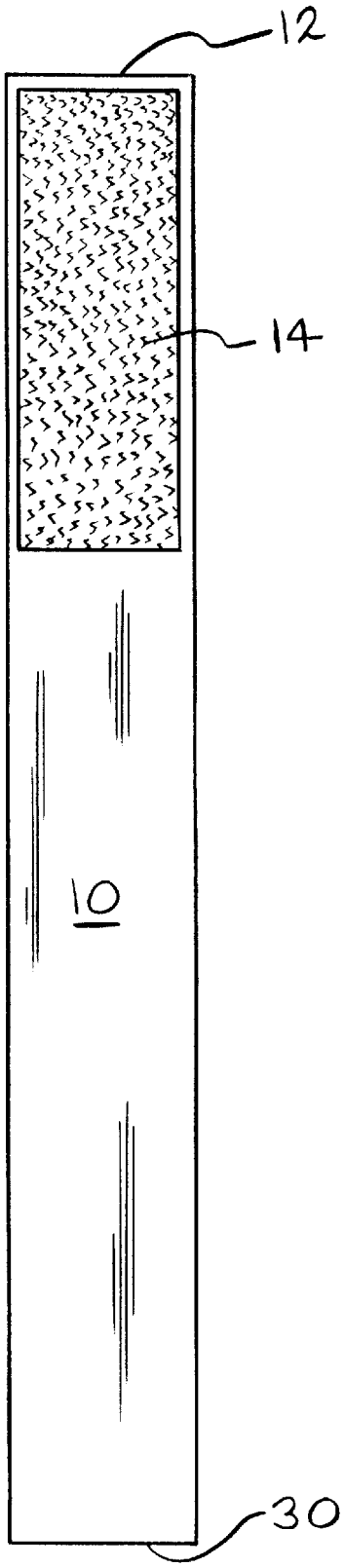

FIG. 1 shows the top view of the strap 10. FIG. 1 shows a strap 10 made out of material. In the preferred embodiment that strap is made out of nylon. The inventor has found that nylon is a desirable fiber in that it is strong and will last long periods of time. However, the strap 10 can be made out of any material that is strong and long lasting. The strap 10 in the preferred embodiment is approximately 17 inches in length and 2 or 3 inches in width. The inventor has found that a strap 10 of 17 inches in length will fit most individual adults hands. On end 12 of strap 10 is a rectangular section 14 of hooks of hook and loop fabric like velcro. In the preferred embodiment this rectangular section is approximately 5 inches long. This section has to be long enough to compensate for the different sizes of hands for the which the strap must wrap around. The inventor has found that the 5 inches of hook fabric on the top of the strap is of sufficient length to allow the strap 10 to be used by most individuals.

Figure 2:
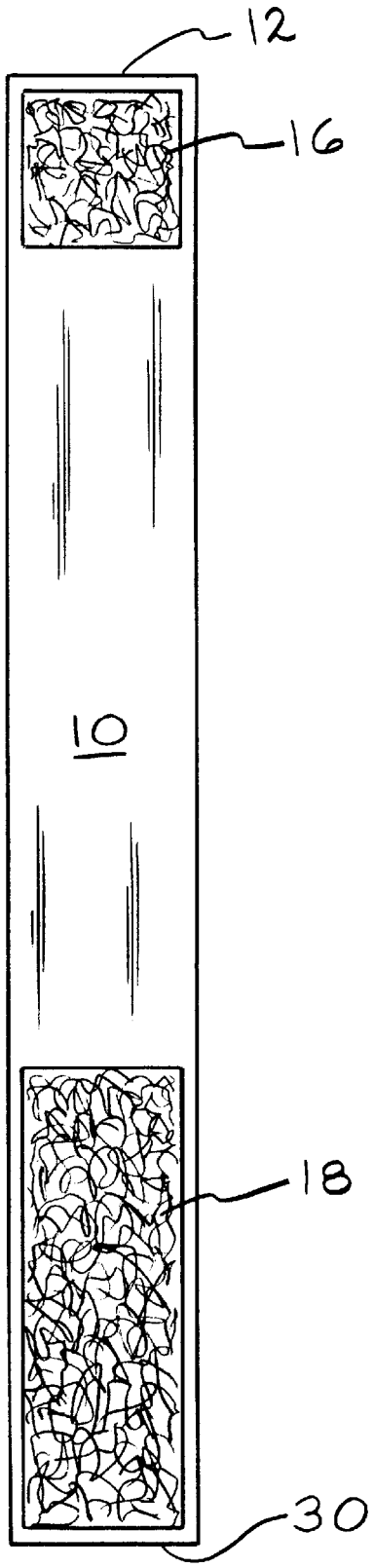

FIG. 2 is a bottom view of the strap 10. End 12 of this opposite side has a small rectangular piece 16 of loop fabric is attached. In the preferred embodiment, this small rectangular piece 16 of loop fabric is approximately 2 inches long. FIG. 2 also shows at the other end 30 on the bottom view of the strap 10 a larger piece 18 of loop fabric is attached. In the preferred embodiment this larger piece 18 of loop fabric is approximately 5 inches long.

Figure 3:
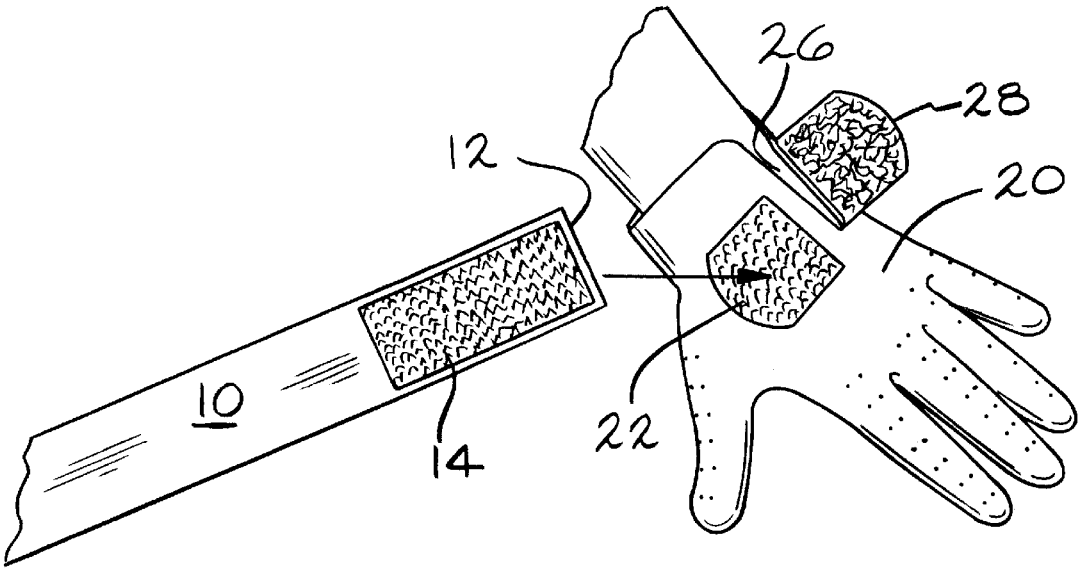

FIG. 3 shows an off the shelf regular golf glove 20 placed over a hand and the strap 10. On golf glove 20 is hook and loop fabric used for tightening the glove around the base of the hand. At the bottom of the glove 20 there is a slit 26. On one side of the slit 26 is the section of hook fabric 22. Protruding from the other side of the slit is a tongue covered with loop fabric 28. The section of hook fabric 22 and the tongue of loupe fabric 28 are designed for closure and tightening of the glove 20 around the hand. In FIG. 3 an arrow points from the end of the strap 12 to the section of loupe fabric 22 on the glove 20.

Figure 4:
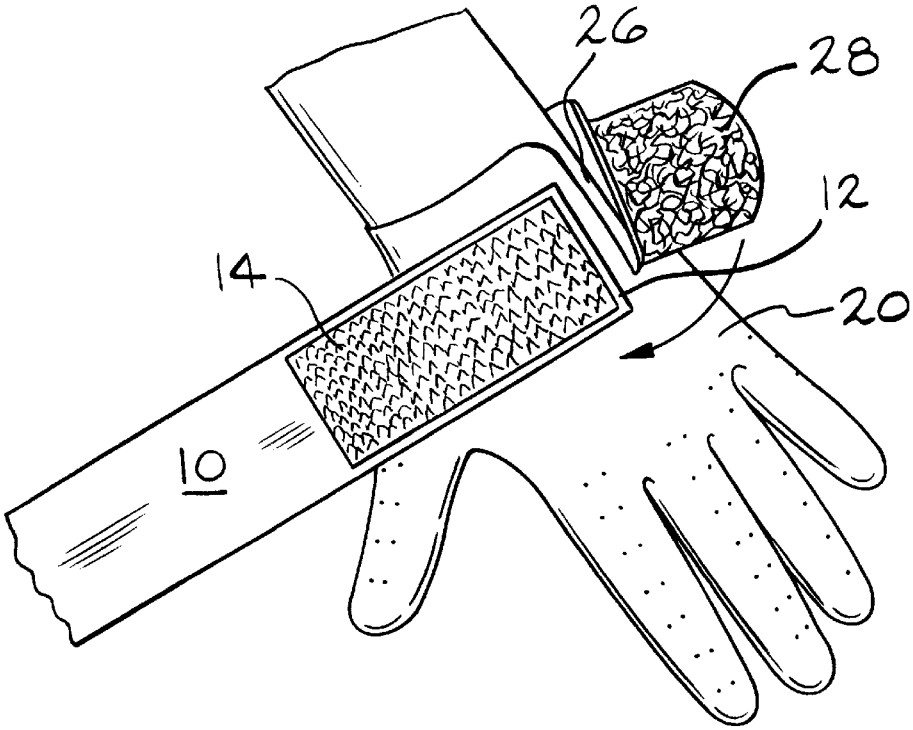

FIG. 4 shows that the end 12 of strap 10 attaches to the glove 20 by attaching the rectangular piece 16 of loop fabric on the bottom of the strap 10 at end 12 to the section of hook fabric 22 on the glove 20. FIG. 4 additionally shows an arrow pointing from the tongue of loupe fabric 28 to the rectangular section of hook fabric 14 on the top of the strap 10. This shows the loupe fabric of the tongue 28 is attached to the rectangular section of hook fabric of the strap 10 as shown in FIG. 5.

Figure 5:
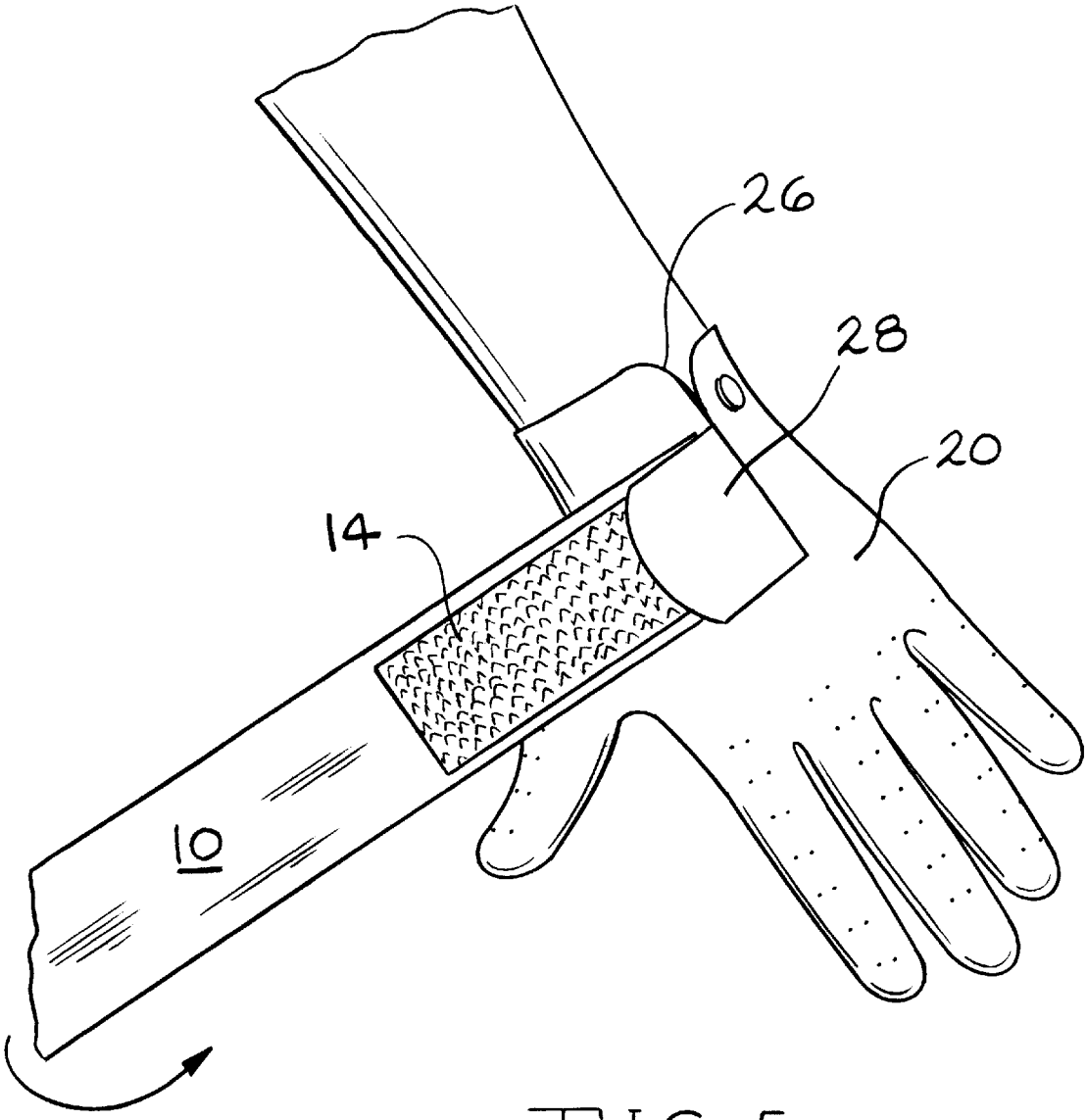

The arrow in FIG. 5 shows how the strap begins to be wrapped around the glove 20 starting over the thumb first. FIG. 5 shows that the strap 10 begins wrapping around the glove 20 at nearly a right angle to the glove 20.

Figure 6:
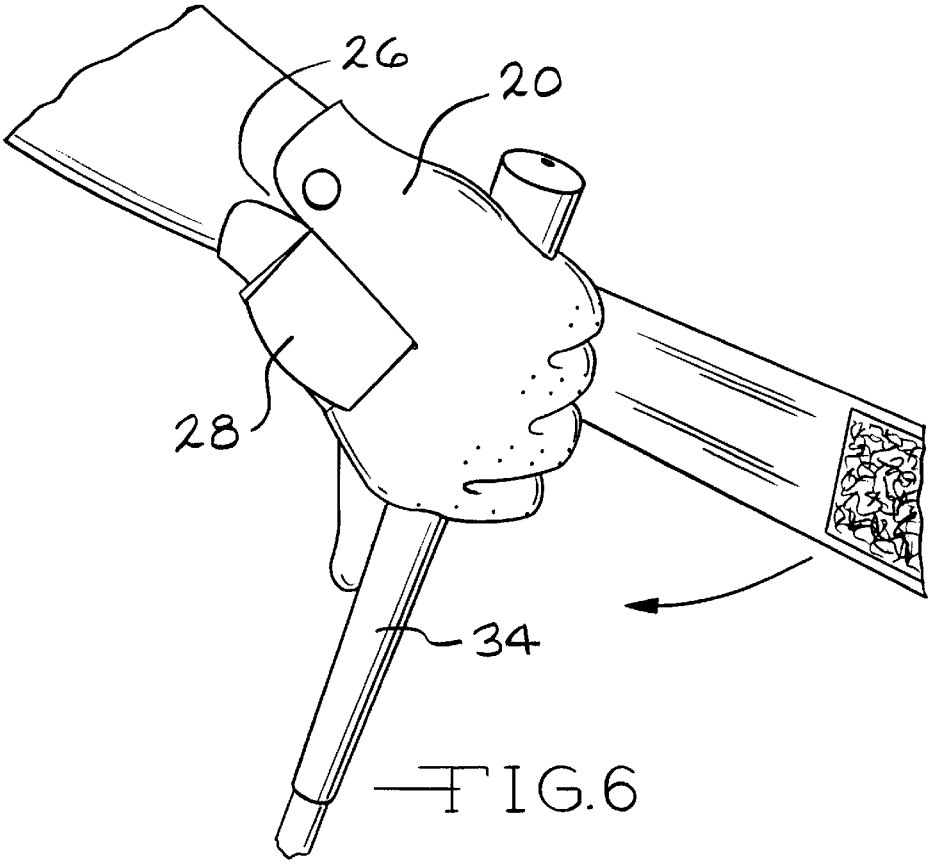

FIG. 6 shows the hand with the glove 20 gripping a golf club. FIG. 6 goes on to show the strap 10 being wrapped around the hand with glove 20. This begins to show the little finger and the ring finger being enclosed. Here as in FIG. 5 the arrow shows how the strap is wrapped around the hand with the glove 20.

Figure 7:
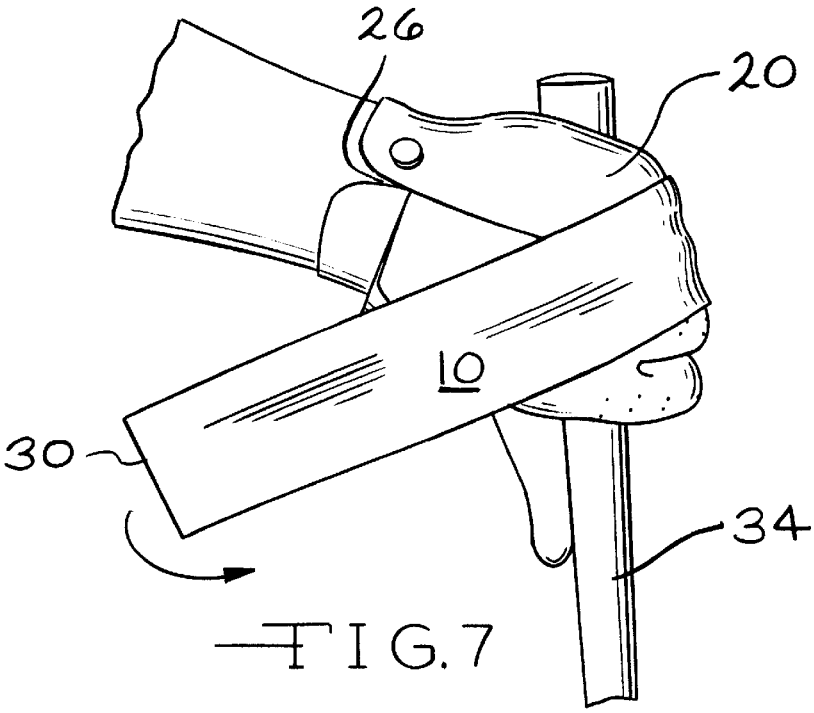

FIG. 7 shows the strap 10 being further wrapped around the little and ring finger while the individual with golf glove 20 is gripping the golf club.

Figure 8:
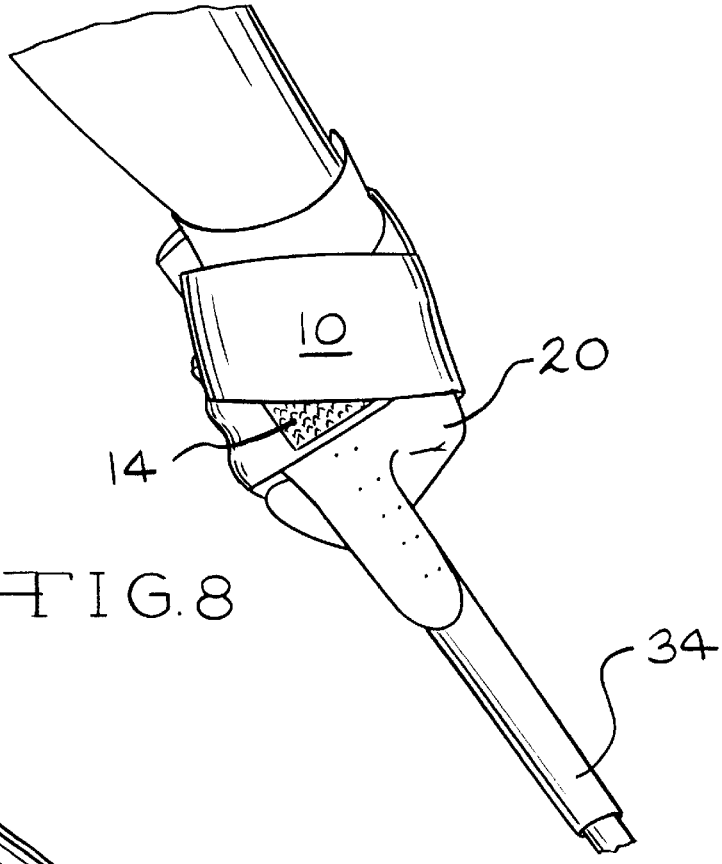
Figure 9:
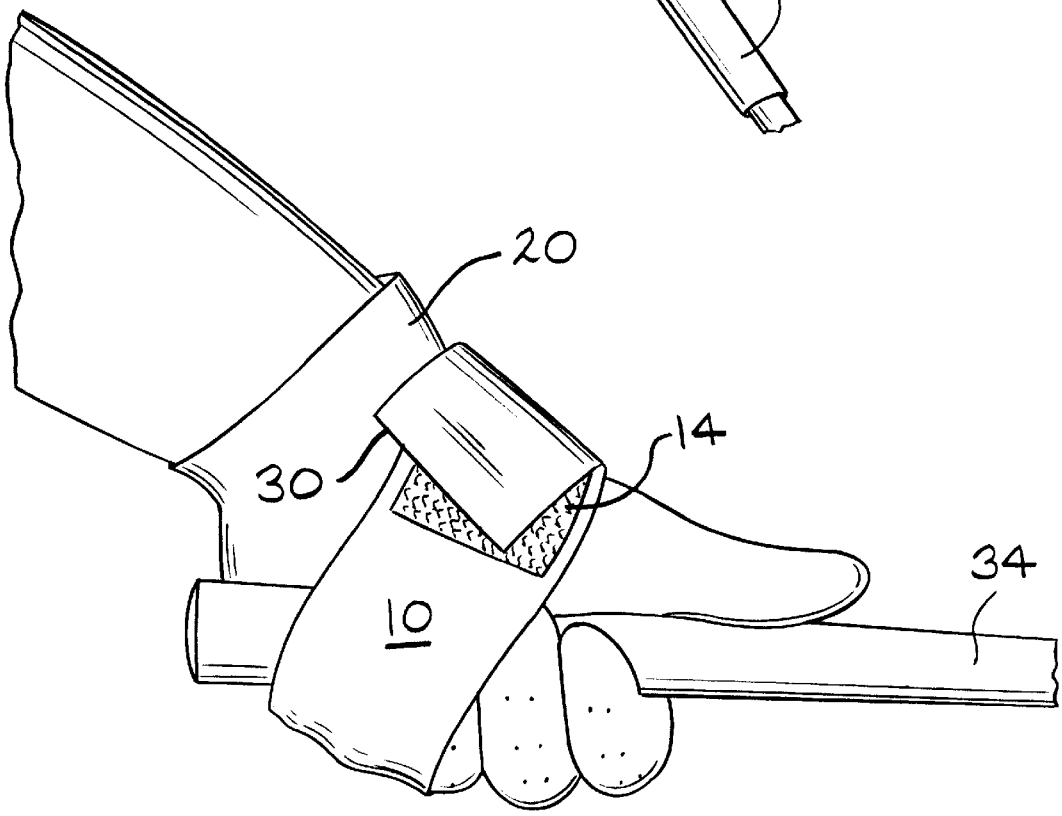

FIG. 8 shows the strap 10 fully wrapped around the glove 20. FIG. 8 shows that the large piece of loupe fabric 18 on the bottom of the strap 10 attaches to the rectangular section 14 of the hook fabric on the top of the strap 10. FIG. 9 is another view of the strap fully wrapped around the hand with the glove 20 gripping the golf club. Showing the entrapment of the little and ring fingers.

Changes and modifications in the specifically described embodiments can be carried out without departing from the scope of the invention which is intended to be limited only by the scope of the appending claims.

I claim:

1. A strap for improving one's grip on a golf club used in conjunction with a golf glove with a closure method that uses hook and loop fabric comprising:

a. a strap with a top and bottom, and;

b. loop fabric of hook and loop fabric on the bottom of said strap; and, c. hook fabric of hook and loop fabric on the top of said strap; and, d. whereby the golf glove is fit over an individuals hand and the individual grips the golf club in his normal grip and the hook and loop fabric on the strap is attached to the hook and loop fabric on the golf glove then the strap is wrapped around the individual's hand and up over his little and ring fingers and then the strap hook fabric on the top of the strap is attached to the loop fabric on the bottom of the strap;

e. Wherein the glove's closure method has a tongue with hook and fabric on the tongue and the hook and loop fabric is attached to the hook and loop fabric of the glove to close and tighten the glove around the hand when the strap is not in place; and, f. after the strap is attached to the hook and loop fabric of the golf glove, the hook and loop fabric on the tongue is pulled tight and attached to the hook and loop fabric on the strap to close and tighten the glove around the hand.

2. A strap for improving ones grip on a golf club as in claim 1 wherein:

a. the loop fabric on the bottom of the strap comprises two pieces of loop fabric.

3. A strap for improving one's grip on a golf club as in claim 2 wherein:

a. one of the pieces of loop fabric is located at one end of the strap; and, b. the other piece of loop fabric is located at the other end of the strap.

4. A strap for improving one's grip on a golf club as in claim 2 wherein:

a. one of the pieces of loop fabric is two or more times larger than the other piece of loop fabric.

5. A strap for improving one's grip on a golf club as in claim 4 wherein:

a. the piece which is larger of loop fabric is approximately 5 inches long.

6. A strap for improving one's grip on a golf club as in claim 4 wherein:

a. the piece which is smaller of loop fabric is approximately 2 inches long.

7. A strap for improving one's grip on a golf club as in claim 2 wherein:

a. the hook fabric is located on one end of the strap.

8. A strap for improving one's grip on a golf club as in claim 2 wherein:

a. the strap is approximate 17 inches long.

9. A strap for improving one's grip on a golf club as in claim 2 wherein:

a. the strap is approximately 2 inches in width.

10. A strap for improving one's grip on a golf club as in claim 2 wherein:

a. the hook fabric is approximately five inches long.

11. A strap for improving one's grip on the golf club as in claim 1 wherein:

a. the strap, after being attached to the golf glove, is wound around the thumb first then over the ring and little finger and then attached to itself.

* * * * *